US005660233A

United States Patent [19]

Sparks

[11] Patent Number: 5,660,233

[45] Date of Patent: Aug. 26, 1997

[54] RISER FOR GREAT WATER DEPTHS

[75] Inventor: Charles Sparks, Le Vesinet, France

[73] Assignee: Institut Francais du Petrole, Rueil Malmaison, France

[21] Appl. No.: 552,921

[22] Filed: Nov. 3, 1995

[30] Foreign Application Priority Data

Nov. 4, 1994 [FR] France ..... 94 13511

[51] Int. Cl.[6] ..... E21B 17/01; E21B 19/09

[52] U.S. Cl. ..... 166/367; 405/195.1; 405/224.2

[58] Field of Search ..... 166/367, 350, 166/355; 405/195.1, 224.2, 223.1, 223.2

[56] References Cited

U.S. PATENT DOCUMENTS

| | | | |
|---|---|---|---|
| 4,142,584 | 3/1979 | Brewer et al. | 405/224.2 X |
| 4,194,568 | 3/1980 | Burési et al. | 166/367 X |
| 4,391,332 | 7/1983 | Fayren | 166/350 |
| 4,397,357 | 8/1983 | Hettinger | 166/345 |
| 4,423,983 | 1/1984 | Dadiras et al. | 405/224.2 |
| 4,593,937 | 6/1986 | Schawann et al. | 285/18 |

FOREIGN PATENT DOCUMENTS

| | | |
|---|---|---|
| 0039589 | 11/1981 | European Pat. Off. . |
| 2444154 | 7/1980 | France . |
| 2653162 | 4/1991 | France . |

OTHER PUBLICATIONS

14th Annual OTC –4317, May 6, 1982, Houston, Texas, pp. 210–211 C.P. Sparks, "Longitudinal Resonant Behavior of Very Deep Water Risers" Entire Document.

*Primary Examiner*—David J. Bagnell

*Attorney, Agent, or Firm*—Antonelli, Terry, Stout & Kraus, LLP

[57] ABSTRACT

A riser for great water depths includes a main tube, peripheral lines, and a base at the lower end of the main tube. The main tube has devices for holding the peripheral lines in position with respect to the main tube. The lower end of each of the peripheral lines is connected with another device placed on the base allowing axial relative movement of at least one of the peripheral lines with respect to the main tube. Also, the riser is provided with a damping device.

13 Claims, 1 Drawing Sheet

RISER FOR GREAT WATER DEPTHS

FIELD OF THE INVENTION

The present invention relates to a riser for great water depths. This riser can be used either in the sphere of drilling or in the sphere of petroleum production.

BACKGROUND OF THE INVENTION

Drilling at very great sea depths, for example above 2000 meters and notably up to 4000 meters, requires a riser architecture that is different from that of current risers.

What is referred to as a riser is an assembly consisting of a central tube, peripheral lines and possibly other equipments. Such a riser allows fluids to be transferred between the water bottom and an installation that is situated at a higher level, i.e. that can be situated substantially at the water surface or underwater, for example just below the surface.

In fact, these risers are subjected to various modes of vibration, such as lateral, axial or torsional modes. The present invention concerns more particularly the axial modes of vibration and the term "natural period" defines the axial natural period of the riser, or that of an element of the riser.

The invention is particularly well suited for a riser connected by its upper part to a floating installation and whose lower end is free, for example after being disconnected from a blowout preventer or BOP, or from a manifold.

When a riser of great length hangs from a drillship and is free at its lower end, the heave of the ship due for example to the wave motion communicates an excitation thereto in the substantially vertical direction. This excitation can induce high stresses in the riser which can damage it significantly and even lead to its breaking.

This excitation phenomenon, which can be maintained and increased, becomes particularly critical when the natural period of the riser becomes at least equal to the minimum value of a period range for which the floating installation could be excited significantly by the heave.

For example, for a conventional drillship, the period range for which such an excitation has strong repercussions on the riser is above 6 seconds.

The risk of excitation of the ship also exists for the 4 to 6-second range, but it is slighter.

The natural period of a riser notably depends on the following parameters: its linear density m or mass per unit of length, its axial rigidity ES corresponding to the product of the Young's modulus E by the structural section S, and its length L.

The calculation of the natural period of the riser also depends on the geometry and on the dimensioning of the riser, and it is for example described in the article OTC 4317, Offshore Technology Conference, 14th Annual OTC in Houston, Tex., May 3–6 1982.

For a water depth of 4000 meters, the "natural" period of a riser of a conventional type used in the petroleum sphere can reach values of the order of 7 seconds, which are within the period range for which a conventional drillship can be significantly excited by the wave motion.

The excitation phenomenon can increase for example with the number of peripheral lines whose mass contributes to increasing the natural period of the assembly consisting of the riser and the lines.

The prior art thus describes risers comprising notably a central tube and peripheral lines consisting of several elements linked together by slip joints, each one of the elements being immovably fastened to the central tube. The mass of each of the lines thus participates in the mass of the whole riser without participating in its rigidity ES, which leads, in case of great depth, to a value of the natural period of the riser that is great enough for the above-cited problems to be encountered.

Furthermore, the increase in the mass of the riser when the water depth increases leads to the emergence of two phenomena which are of little importance and often disregarded for slight and average water depths but which, in the case of great water depths, become much more important and can condition the dimensioning and the characteristics of the risers. The causes and the effects of these phenomena must be carefully studied.

The increase in the supertensions due to the inertia of the riser during strong storms can lead to a tension decrease and/or to a compression, notably in the upper part of the riser, and induce therein, in correlation with the other motions (surge, sway) and the direct action of the wave motion, crippling bending stresses.

The rise in the natural period of longitudinal or axial vibrations towards values for which the heave amplitude cannot be disregarded can limit considerably, even in relatively calm weather, the operations intended for manoeuvring the riser because of the risks they would present.

SUMMARY OF THE INVENTION

The present invention consists in obtaining, for the lines and/or the tubes that make up the riser, different natural period values for at least two lines in order to obtain a relative motion between at least one of the lines and the riser. To that effect, the lower end of the peripheral lines is connected to a device allowing its relative axial motion with respect to the central tube.

The materials and the dimensioning of the peripheral lines and of the central tube are preferably selected so as to obtain the lowest possible period values.

The natural period values of the peripheral lines and that of the central tube are advantageously different so as to generate a relative motion which, associated with auxiliary means, for example a damper, can lead to a dissipation of energy and to a damping of the axial motions of the central tube and of the peripheral lines.

The invention relates to a simple and little expensive device allowing the drawbacks of the above-cited prior art to be overcome.

The invention relates to a riser for great water depths comprising a main tube or central tube, the central tube having an axial natural period $T_1$, several peripheral lines, each of the peripheral lines having its own axial period Ti and the peripheral lines being held in position with respect to the central tube by fastening means, a base situated at the lower end of the central tube. It is characterized in that the lower end of each of the peripheral lines is connected to a device placed on the base, the device being suited for allowing a relative axial motion of at least one of the peripheral lines with respect to the central tube, and in that the riser comprises means for damping the axial motion.

According to an embodiment, the device allowing the axial motion comprises damping means.

The axial motion is preferably achieved between the central tube and at least one of the lines and/or between several lines.

The values of the axial natural periods Ti of the peripheral lines are for example less than the value of the axial natural period of the central tube $T_1$.

According to an embodiment, at least one of the elements of the central tube or at least one of the peripheral lines is for example made at least partly from a metallic material of low density such as a titanium alloy and/or comprises a composite, and the dimensions of the peripheral lines and of the central tube are so selected for example that the values of the natural periods $T_1$ and Ti are less than 6 seconds and preferably at least less than 4 seconds.

The difference between the values of the natural periods of the central tube and of the peripheral lines is advantageously selected to generate an axial relative motion between the central tube and at least one of the lines allowing the axial vibrations of the central tube and of the peripheral lines to be damped.

The device allowing the axial motion can comprise stop rings.

The means for holding the peripheral lines in position are for example made from a material withstanding lateral stresses and frictions.

At least one of the peripheral lines can be immovably attached to the central tube in the neighbourhood of the upper end of the tube by means of a fastening device.

According to an embodiment, the peripheral lines are for example fastened to the central tube by means of the device which is at a distance d from the upper end of the central tube.

At least one of the peripheral lines can hang by its upper end from the upper end of the central tube by means of a suspension device.

The peripheral lines consist for example of several elements connected together by fastening means.

The present invention further relates to a drilling installation for great water depths comprising a floating installation and a riser according to the invention. The floating installation is equipped with a damping device. The damping device thus allows for example the descent of the riser to be damped when it has been violently lifted as a result of particularly unfavourable weather conditions.

One of the problems solved by the invention consists in obtaining a riser whose architecture prevents and/or minimizes the excitation phenomena leading to its deterioration.

Another problem solved by the invention is to have a riser having a natural period value that is less than that of a riser of a conventional architecture, designed for the same water depth.

The riser according to the invention also allows to damp the axial motions of the central tube and of the peripheral lines, notably due to the heave of the drillship, and therefore to decrease the stresses induced in the riser.

BRIEF DESCRIPTION OF THE DRAWINGS

Other features and advantages of the invention will be clear from reading the description hereafter of embodiments given by way of non limitative example, with reference to the accompanying drawings in which.

DESCRIPTION OF THE PREFERRED EMBODIMENTS

In order to better define the present invention, the description given hereafter by way of non limitative example relates to a uniform riser, i.e. a riser having a constant linear density and rigidity ES over its total length, the riser being only fastened to a floating installation by its upper end and free at the level of its lower end. In this case, the axial natural period value T is given by the formula as follows:

$$T=4L/c \tag{1}$$

where

L is the length of the riser, c is the celerity or propagation velocity of the axial stress waves in the riser, which can be obtained from the formula $$c=\sqrt{(ES/m)}.$$

ES is the axial rigidity of the riser, which corresponds to the product of the structural section S of the riser and of its Young's modulus E, and m is the linear density of the riser.

It can also be observed that, for such a riser excited at its head by a sinusoidal motion of amplitude $U_o$, in the absence of a damping, the amplitude $U_x$ of the motion induced at a point at a distance x below the head is given by:

$$U_x/U_o=(\cos \omega(L-x)/c)/(\cos \omega L/c))$$

where ω is the circular frequency of the excitation, given by $(2\pi/T_e)$, where $T_e$ is the period of the excitation.

At the lower end of the riser, the amplitude of the motion becomes:

$$U_L/U_o=1/(\cos \omega L/c).$$

We can deduce from the above-mentioned equations that two risers of equal length L subjected to the same sinusoidal head excitation of amplitude $U_o$ and of circular frequency ω would have different responses in amplitude, generally over their total length, providing that the celerities c are different for the two risers. The more different the celerities, the more different the responses. Since the natural period of a riser also depends on the celerity, we can deduce that two risers of equal length subjected to the same head excitation have different responses and therefore a relative motion between them, providing that their natural periods are different.

For a riser comprising a central tube and/or lines whose values of m, E and S are not constant over its total length and/or comprise other elements, the calculation of the natural period and of the response of such elements, including a damping, is described in the above-cited document OTC 4317.

Figure 1:
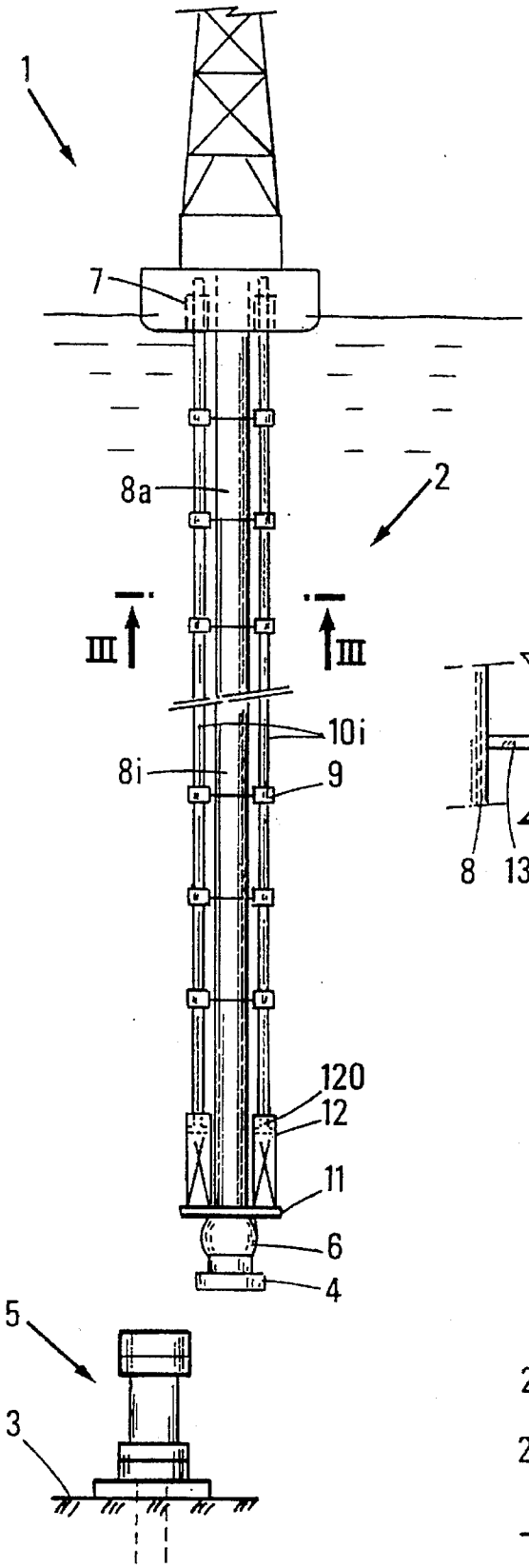
FIG. 1 is an overall diagram of a riser according to the invention.

In FIG. 1, reference number 1 refers to a surface installation such as a ship to which the riser 2 for great water depths is connected.

The means for fastening this riser to a BOP 5 at the bottom of the water 3 comprise for example connection means 4 and a joint such as a flexible joint 6.

In the example described hereunder, the riser is disconnected from the BOP.

The riser as a whole is designated by reference number 2. It comprises a central tube 8 equipped with means 7, 9 allowing respectively the hitching of the peripheral lines onto the central tube and the passage and the holding up of the peripheral lines 10*i*, a base 11 situated at the lower end of riser 2, and devices 12, for example immovably fastened to base 11, allowing the axial relative motion of the lower ends of the peripheral lines with respect to the central tube.

The devices 12 into which the lower ends of the peripheral lines fit are designed to leave a certain degree of freedom at the end of the line in its axial motion with respect to the central tube.

They are for example provided with means or stop rings 120 allowing to prevent the end of the line from coming out under the effect of particularly strong or violent axial motions.

They advantageously comprise means for damping shocks when the line is subjected to violent motions, more specifically at the time of the lower and upper limit of travel of the line.

Devices 12 and the means that are possibly positioned inside can also contribute to damping axial relative motions by absorbing for example part of the energy.

Devices 12 are for example slip joints or any other type of devices exhibiting the above-cited characteristics.

The central tube 8 can consist of several elements 8*a*, 8*b*, . . . 8*i*, . . . 8*n*. The central tube defined thus has a natural period $T_1$ determined from the formula:

$$T_1=4L_1/c_1$$

where $c_1$ is the celerity of the axial stress waves in the central tube defined above with Equation (1) with $m_1$ the linear density of the central tube, $L_1$ its length, $E_1$ its Young's modulus and $S_1$ its structural section.

The values $m_1$, $S_1$ and $E_1$ are assumed to be constant or their variation is assumed to be so slight that it can be disregarded in the calculation.

The peripheral lines 10 themselves can comprise several elements that are not shown in the figure for clarity reasons, these elements being connected to each other by fastening means allowing notably the axial loads to be transmitted between them, for example screws.

According to another embodiment variant, the peripheral lines 10*i* all have the same length.

The lines have each a natural period of excitation $T_i$ determined from the following formula $$T_i=4L_i/c_i$$

where $c_i$ is the celerity of the waves in a peripheral line i with $m_i$ the linear density of line i, $L_i$ its length, $E_i$ its Young's modulus and $S_i$ its structural section.

The materials and the dimensioning of the peripheral lines 10*i* and of the central tube are notably so selected that the values of the natural periods of the central tube $T_1$ and that of the lines $T_i$ are as low as possible, for example less than or equal to 6 seconds and preferably at least less than 4 seconds.

The values of the natural periods of the central tube $T_1$ and that of the lines $T_i$ are selected different.

The values of the natural periods $T_i$ of the lines are advantageously lower than the value of the natural period $T_1$ of the central tube.

Rather different values are sought for the periods $T_1$ and $T_i$. In fact, the existence of a difference between the values of the natural periods generates a relative motion between the central tube and the peripheral lines which can, when combined with a friction phenomenon in the guides described hereafter, lead to a decrease in the axial vibrations of the central tube 8 and of the peripheral lines 10*i*.

The peripheral lines 10*i* are for example connected to the central tube only at the level of their upper end with the head of the central tube, for example immovably fastened by means of a device 7, and they run through the means or guides 9 immovably fastened to the central tube 8 by means of arms 13. The lower end of each of the peripheral lines 10*i* fits into a device 12 described hereunder. The peripheral lines are thus under tensile stress due to their own weight.

According to another embodiment, the peripheral lines are fastened to the central tube at only one point by means of the fastening device 7 situated for example at a distance d from the upper end of the central tube 8, instead of being fastened at the level of the upper end of the central tube or riser head. The distance d is for example determined as a function of the length of the riser that is desired to be raised in order to prevent its lower part from touching the sea bottom and/or the wellhead equipments, for example the BOP. Such an embodiment is particularly well suited for difficult offshore working conditions.

The guides are designed to allow the relative axial motion between the peripheral lines 10*i* and the central tube 8.

Figure 4A:
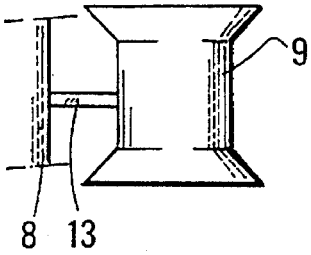
Figure 4B:
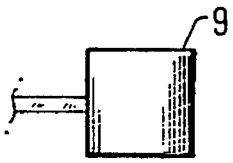

They can have various shapes (FIGS. 4A and 4B), of the simple annular type, or they can come in the shape of a ring with a flare-shaped end such as the shape of a funnel. They can consist of a single piece or of several parts.

The shape of the guide can be determined as a function of the riser setting procedure described hereafter.

The inside diameter of these guides can be selected so as to leave a sufficient clearance between a peripheral line and the guide. These guides can thus also be so adapted that the relative axial sliding between a guide and a peripheral line, generated by the difference of the period values associated with the friction phenomenon, leads to a damping of the vibrations.

They are for example made from a material that is sufficiently resistant to the lateral stresses resulting from the deflection of the peripheral lines caused for example by the wave motion and friction. Furthermore, this material is selected to avoid the deterioration of the line due to its friction inside a guide.

The distance between two successive guides, their number and the way they are distributed on the central tube can be determined to avoid the buckling of the riser when it is connected to the BOP and subjected to the pressurized fluid contained in the central tube.

Figure 2:
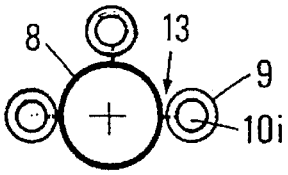

FIG. 2 is a cross-section along the line AA of the riser according to the invention, showing the layout of the riser 2 equipped with guides 9 immovably fastened to the central tube by means of arms 13 guiding the peripheral lines 10*i*.

Figure 3:
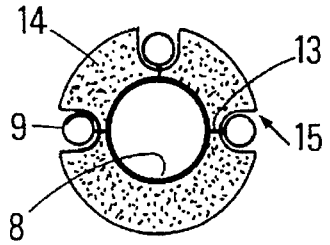
FIGS. 2 and 3 are cross-sections of two possible embodiments of this riser, FIGS. 4A and 4B schematize possible shapes for the guides of the periphal lines.

According to another embodiment variant described in FIG. 3, the riser is surrounded by floats 14 arranged continuously or intermittently along the riser. In this case, float 14 comprises recesses 15 suited to receive the arms and the guides 9 of the peripheral lines. The floats are fastened to the central tube and/or to the peripheral lines by means that are conventionally used in the petroleum sphere.

An example of the layout of floats on a riser is given in the claimant's patent application FR-2,653,162.

Various materials can be used for the central tube 8 and the peripheral lines 10*i*. The materials preferably have high resistances, low density values, such as titanium, composites with an organic matrix or others, the matrix can be reinforced with glass fibers, Kevlar or carbon.

Reinforcements obtained by hooping can also be used. This technique allows the mechanical strength of a tube to be improved without increasing its weight excessively.

The central tube and/or the peripheral lines can thus be hooped, which allows to obtain elements with good mechanical performances, notably with the pressure differences that exist between the inner part of these elements and the ambient medium.

In case of axial motions with high amplitudes, the travel length provided in devices 12 can be inadequate to avoid the shock problems undergone by the peripheral lines. In order to prevent such shocks from causing the buckling of a line, it is possible to fasten its upper end differently to the central tube.

In this case, the peripheral line is for example simply suspended, for example in the neighbourhood of the riser head, instead of being immovably fastened thereto. This other connection method utilizes a fastening device 7 which allows the peripheral lines to go up with respect to the central tube in case of excessive upward axial motions. Then, under the effect of gravity, the line goes down again with respect to the central tube and takes up its initial position again, i.e. it is again hanging in the neighbourhood of the riser head. This fastening method is particularly advantageous because it prevents the buckling of the riser.

When such a riser is reconnected to a BOP, it is then advisable to change this free mode of fastening of the peripheral lines with respect to the riser head and to prefer a fastening mode for which the upper end of a line is immovably attached to the upper part of the central tube.

Figure 5:
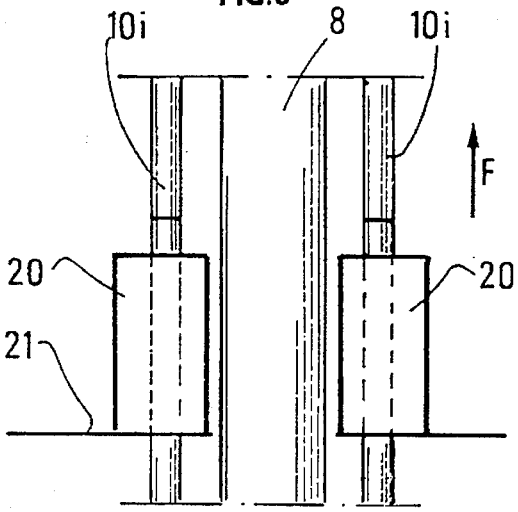
FIG. 5 is a detail of the link between the riser and a surface installation.

FIG. 5 shows a detail of the link between the upper end of the riser and the floating installation 1 (FIG. 1).

The floating installation is advantageously equipped with a damping device 20 whose purpose is notably to damp the descent of the riser.

When the weather conditions become particularly bad and if the motions generated by the waves are violent, the violence of these motions can lead to a high acceleration that is transmitted to the riser. The riser thus goes up with respect to the floor 21 of the floating installation.

When the disturbance has died down, the riser will fall back onto this floor. In order to damp this fall and to prevent riser damage, the floating installation is provided with a device 20 of the damper type.

This device has for example two states, a first state or state of rest for standard conditions for which the riser head is in proximity to the floor of the floating installation and a second state that is activated under certain conditions.

The change from the first state to the second state can result from a weight variation. Under standard conditions, the device 20 thus feels the effect of the weight of the riser. When the riser is induced to lift, the weight variation felt by device 20 under the effect of the separation leads to the change of state of the device.

For a device 20 comprising a spring and a damper, the change from the first to the second state is translated into an extension of the spring as shown by arrow F, upwards towards the riser head. During its descent, the riser head encounters the damper which slows up its descent. The characteristics of the damper can thus be so selected that the damping factor increases as a function of the descent of the riser.

Without departing from the scope of the invention, it is possible to use any type of device fulfilling this function, for example a cushion connected to a fluid tank, the fluid inflow being controlled by a valve activated at the time of a weight variation.

The setting of the peripheral lines with respect to the riser equipped with the base and the damping devices can be considered in several ways described hereafter by way of non limitative example.

According to a first embodiment, which is particularly advantageous when it is desired to solve storage problems and when the central tube has not been previously equipped with guides, the tube is provided with guides as it is lowered from the floating installation towards the wellhead, then the peripheral lines are passed through the guides.

The central tube can be previously equipped with guide positioning means which allow the guides to be positioned in definite places along the central tube and oriented with respect to the central tube.

The guides can have the shape of a ring with conical ends, for example funnel-shaped, so as to facilitate the passage of the peripheral lines in the guides.

They can also consist of rings made up of several parts, for example two parts, a guide or ring is positioned along the central tube, a peripheral line is passed into the ring that is closed thereafter, as the central tube is lowered.

I claim:

1. A riser for great water depths comprising a main tube, said main tube having an axial natural period $T_1$, several peripheral lines, each one of said peripheral lines having its own axial natural period Ti and said peripheral lines being held in position with respect to said main tube by fastening means, a base situated at the lower end of the tube characterized in that the lower end of each said peripheral lines is connected to a device placed on the base, said device being suited to allow a relative axial motion of at least one of said peripheral lines with respect to said main tube and in that the riser also comprises means for damping the axial motion.

2. A riser as claimed in claim 1, characterized in that the device allowing the axial motion comprises damping means.

3. A riser as claimed in claim 1, characterized in that the values of the axial natural periods Ti of the peripheral lines are less than the value of the axial natural period of the main tube $T_1$.

4. A riser as claimed in claim 3, characterized in that the difference between the values of the natural periods of the main tube and those of the peripheral lines are selected to generate a relative amplitude motion between the main tube and at least one of said lines allowing the axial vibrations of the main tube and of the peripheral lines to be damped.

5. A riser as claimed in claim 1, characterized in that the main tube comprises several tubular elements, at least one of the elements of the main tube or at least one of the peripheral lines is made at least partly from a metallic material of low density and/or comprises a composite material, and in that the dimensions of said peripheral lines and of said main tube are so selected that the values of the natural periods $T_1$ and Ti are less than 6 seconds.

6. A riser as claimed in claim 5, wherein the metallic material of low density comprises a titanium alloy.

7. A riser as claimed in claim 5, wherein the dimensions of said peripheral lines and of said main tube are so selected that the values of the natural periods $T_1$ and Ti are at least less than 4 seconds.

8. A riser as claimed in claim 1, characterized in that the device allowing the axial motion comprises stop rings.

9. A riser as claimed in claim 1, characterized in that the fastening means for holding said peripheral lines in position are made from a material withstanding lateral stresses and frictions.

10. A riser as claimed in claim 1, characterized in that at least one of the peripheral lines is immovably fastened to the main tube in the neighbourhood of the upper end of said tube by the fastening means.

11. A riser as claimed in claim 10, characterized in that the peripheral lines are fastened to the main tube by fastening means situated at a distance d from the upper end of the main tube.

12. A riser as claimed in claim 10, characterized in that at least one of said peripheral lines is hanging by its upper end from the upper end of the main tube fastening by means comprising a suspension device.

13. A riser as claimed in claim 1, characterized in that said peripheral lines consist of several elements connected to each other by other fastening means.

* * * * *